US006538189B1

(12) United States Patent
Ethington

(10) Patent No.: US 6,538,189 B1
(45) Date of Patent: Mar. 25, 2003

(54) WIND CONTROLLER FOR MUSIC SYNTHESIZERS

(76) Inventor: Russell A. Ethington, 172 Locust La., Irvington, NY (US) 10533

( * ) Notice: Subject to any disclaimer, the term of this patent is extended or adjusted under 35 U.S.C. 154(b) by 0 days.

(21) Appl. No.: 10/061,583

(22) Filed: Feb. 1, 2002

Related U.S. Application Data

(60) Provisional application No. 60/266,242, filed on Feb. 2, 2001.

(51) Int. Cl.[7] ..... G10H 1/06; G10H 1/18

(52) U.S. Cl. ..... 84/615; 84/622; 84/645; 84/735; 84/742

(58) Field of Search ..... 84/615–620, 622–625, 84/645, 653–661, 678–700, 735, 736, 742, 719, 720, 744, 745

(56) References Cited

U.S. PATENT DOCUMENTS

| | | | | |
|---|---|---|---|---|
| 4,038,895 A | | 8/1977 | Clement et al. | |
| 4,230,012 A | | 10/1980 | Bommersbach et al. | |
| 4,338,849 A | * | 7/1982 | Turner | 84/615 X |
| 4,724,736 A | | 2/1988 | Isozaki | |
| 4,957,032 A | | 9/1990 | Hirano et al. | |
| 4,993,307 A | | 2/1991 | Sakashita | |
| 5,024,133 A | * | 6/1991 | Nakanishi et al. | 84/615 |
| 5,125,315 A | | 6/1992 | Kawashima | |
| 5,245,130 A | * | 9/1993 | Wheaton | 84/658 X |
| 5,354,947 A | * | 10/1994 | Kunimoto et al. | 84/622 |
| 5,403,966 A | | 4/1995 | Kawashima et al. | |
| 5,453,571 A | | 9/1995 | Adachi et al. | |
| 5,744,740 A | | 4/1998 | Mizuno | |
| 6,002,080 A | | 12/1999 | Tanaka | |

* cited by examiner

*Primary Examiner*—Stanley J. Witkowski
(74) *Attorney, Agent, or Firm*—Reising, Ethington, Barnes, Kisselle, Learman & McCulloch, P.C.

(57) ABSTRACT

A wind controller is disclosed which provides glitch-free playing of the instrument by using key position sensors which produce tristate logic signals indicating released, held, or transition positions of each key. Logic circuitry processes the key position signals and prevents any note from sounding when any of the keys is in transition between the released and held positions. The controller also allows the player to select alternate fingering charts which avoid "mine field" fingerings and which are created and downloaded to the wind controller using a personal computer. A set of chord keys and a computer program allows the player to register, without sounding, a series of notes to make up a chord using a registration key and an enable/disable key which alternately activates the last registered chord for playing or deactivates it to return to monophonic mode. Another registration key is provided to register another chord whereby an endless progression of chords can be played in succession.

15 Claims, 6 Drawing Sheets

WIND CONTROLLER FOR MUSIC SYNTHESIZERS

This application is based upon Provisional application No. 60/266,242, filed Feb. 2, 2001, the priority of which is hereby claimed for this application.

FIELD OF THE INVENTION

This invention relates to an electronic wind controller for simulating, the playing characteristics of acoustic woodwind instruments. More particularly, this invention provides certain improvements in wind controllers for making such instruments easier to play, more expressive and capable of producing chords.

BACKGROUND OF THE INVENTION

In the technology of digital music and sound, there is a need for certain improvements, especially in wind controllers for simulating the playing characteristics of woodwind instruments. In digital music, the MIDI (Musical Instrument Digital Interface) standard is both a hardware and software data transmission specification. This widely used standard specifies a scheme for connecting music synthesizers, controllers, and other music processing equipment. The standard calls for unidirectional, serial data transmission at 31.25K bits per second between devices. The standard also specifies a data protocol for exchanging musical performance data, control information, and other data. Typically, a MIDI-compatible musical instrument such as a keyboard or wind controller has a MIDI output which can be connected to the MIDI input of a synthesizer. When notes are played on the instrument, MIDI data flows via the serial data link to the synthesizer where it is interpreted and converted into an analog waveform suitable for amplification, listening on headphones or speakers, or recording. MIDI messages are usually short sequences of data bytes used to convey actions to the synthesizer. Each MIDI message begins with a command byte, such as "note on" or "note off". Additional bytes of information are added to the message to indicate which pitch should be played (called a note "value"), and how loudly (called the "velocity"). A "note on" message will cause a pitch to be produced by the synthesizer and sustained until a corresponding "note off" message arrives. Furthermore, polyphony (more than one note playing at a time) can be achieved by sending multiple "note on" messages in a row. A synthesizer receiving multiple "note on" messages will produce the pitches together as a chord. The data rate used by MIDI is sufficiently high that the sequential, but nearly simultaneous, arrival of these messages cannot be discerned by the listener. MIDI provides for numerous other commands and control messages used for things like synthesizer programming and data transfer.

Though relatively inexpensive when compared to the cost of a high quality saxophone, clarinet, or flute, the wind controller has failed to gain widespread acceptance among woodwind players. The failure of these instruments to catch on can probably be attributed to their major shortcoming; the high degree of difficulty of playing the commercially available wind controllers well. Even musicians with a technical mastery over traditional acoustic woodwinds find the wind controller to be difficult, if not impossible, to play with equal finesse.

In digital music, the instruments themselves have no acoustic properties whatsoever and are made of computers, switches and transducers of various description. Sounds are "triggered" through the production of data signals, such as MIDI data, rather than being produced by an acoustic process. The accidental triggering of a note, in MIDI parlance, has become known as a "glitch". Glitches usually happen during the transition between two notes. But each type of electronic controller has its own characteristic glitch risk. With keyboards there is almost no risk, whereas with wind controllers the risk of glitching is considerable.

Presently, wind controllers are wired with a single switch at each key position, where each key corresponds roughly to a key on the woodwind instrument, such as a saxophone, which is simulated by the controller. Keys are either depressed or not and thus each key on the controller has two states or positions, up or released and down or held. Due in part to the nature of woodwind fingerings, when a musician makes a note transition that calls for a state change in more than one key, there is a glitch risk, as will be described below.

Consider the following example of how a glitch can arise on a wind controller such as the Yamaha WX-11. A transition from the note G# to the note C# calls for four keys to go from a closed position to an open position. If all four keys are lifted at exactly the same instant we will have a clean, glitch-free transition between G# and C# with no other notes sounding. However, if there is a very slight difference (as measured by a 32 KHz clock) in transition times, a glitch will arise. This obtains because, out of all of the possible key combinations involving the same four keys as those in the G# to C# transition, five combinations represent actual notes. For a performer playing with less than machine-like precision, the wind controller will recognize (on the way to C#) a different note transition than the one intended. Perhaps it will play G#-A-C#, or even G#-G-C-C#. This is just one of many similar examples which frustrate even very accomplished woodwind players trying to make use of a wind controller.

There is a need, as set forth above, in wind controllers for preventing the accidental triggering of a note, i.e. an event which has come to be known as a "glitch".

In electronic wind controllers, the fingering positions of the counterpart acoustic instrument, such as the saxophone, are mostly preserved so that a musician familiar with a saxophone will be able to readily learn to play a wind controller. This is done as a convenience when, in fact, a wind controller could have any arbitrary fingering chart imaginable. In an acoustic instrument such as a saxophone, clarinet, or flute the fingerings on the instrument have been determined largely by the laws of physics, the fingering charts for these instruments are subject to the acoustic properties of the instrument and therefore are not ideal for the player. As any woodwind player can attest, each of the twelve major and minor keys has its own characteristic, or idiomatic "feel". Some musical keys are easier to play in than others. A standard woodwind fingering chart shows the primary fingerings for the instrument, and some charts show a few alternate fingerings, too. But to a skilled musician, the alternate fingerings on the instrument play a very important role and are used often. In fact many "undocumented" alternate fingerings are learned by experimentation and discovery by musicians looking to achieve a kind of mastery over the instrument.

Electronic musical instrument makers have overlooked this aspect of woodwind playing almost entirely. Current instruments fail to introduce new secondary, or alternate, fingerings that will be of use to the player. Furthermore, ideally a musician would prefer if the many unassigned key combinations would not create a sound at all. In the prior art (for an example, Yamaha WX-11), unfortunately almost every possible key combination on the instrument produces a note. This makes the instrument into a kind of "mine field" full of unwanted fingerings that make it more difficult to play, increase the glitch risk described above, and introduce key combinations which are not useful. There is a need, as set forth above, to provide wind controllers with customizable secondary, or alternate fingerings that will be of use to the player.

Although the wind controller technology is highly developed, there remains a need for providing the wind controller with the capability of playing chords. Examples of chording instruments are, of course, the piano, the guitar, and even the harmonica. Even though traditional acoustic woodwinds are not polyphonic and hence are not chording instruments it would be a desirable capability for a wind controller. Although some devices like harmonizers are available to create preset chords and intervals, and MIDI sustain pedals can help produce chords by layering sustained notes, these devices do not meet the need for the wind controller to play chords.

In the musical context of a jazz solo, the art of "comping" is a form of accompaniment to a soloist providing the harmonic structure for improvisation. Comping is the practice of playing through a chord progression using voicings selected extemporaneously by an accompanist. Giving the woodwind player the ability to play this kind of accompaniment for another soloist, or for other purposes could greatly transform the role of the woodwind instrument in ways that aren't entirely foreseeable. One use would be for a soloist to self-accompany. Combining this new chording capability of the wind controller with off-board MIDI software, one could actually play sustained chords and play a melody "over" the chord having all notes sounding together. There is a need, as set forth above, for a wind controller which is capable of playing chords.

Wind controllers for music synthesizers are disclosed in the following patents. In general, the prior patents relate to wind controllers which are provided with special features for sound production.

The Clement et al. U.S. Pat. No. 4,038,895, granted Aug. 2, 1976, describes a wind controller for simulating a saxophone that comprises a plurality of keys and a mouthpiece with a pressure transducer. Actuation of the keys in a manner similar to that of the saxophone provides a combination of key pulses which are applied to a key decoder which produces a binary output corresponding to the combination of key pulses. A digital-to-analog converter provides an analog tone signal which is applied to a tone frequency generator the output of which is processed to produce audible musical sounds.

The Sakashita U.S. Pat. No. 4,993,307, granted Feb. 19, 1991 describes an electronic wind controller for simulating an acoustic saxophone. This instrument is provided with pitch designation switches actuated by keys fingered by the player and also with coupler pitch difference setting switches for use by the player. A breath sensor provides a signal corresponding to the strength of the breath of the player.

The Kawashima U.S. Pat. No. 5,125,315, granted Jun. 30, 1992, discloses an electronic wind controller provided with features for selecting tone color to simulate a so-called natural or acoustic saxophone. This patent describes the use of simple on/off switches actuated by fingering keys for pitch selection.

The Kawashima et al. U.S. Pat. No. 5,403,966, granted Apr. 4, 1995, discloses an electronic wind controller of the saxophone or recorder type which is adapted for playing chords.

The Tanaka U.S. Pat. No. 6,002,080, granted Dec. 14, 1999, describes an electronic wind instrument which simulates an acoustic saxophone and is provided with alternate fingering arrangements.

The Adachi et al. U.S. Pat. No. 5,453,571, granted Sep. 26, 1995, describes an electronic keyboard musical instrument with a plurality of keys each of which is provided with two sensors including a stroke sensor and a touch response switch which serve as an initial sensor operated during depression of each of the keys.

The Mizuno U.S. Pat. No. 5,744,740, granted Apr. 28, 1998, describes an electronic musical instrument which cooperates with a MIDI instrument to generate musical tones in a desired manner arbitrarily set by a human operator.

A general object of this invention is to provide a wind controller with certain improvements to make the instrument easier to play, more expressive and capable of producing chords and which overcomes certain disadvantages of the prior art.

SUMMARY OF THE INVENTION

In accordance with this invention, an improved wind controller is provided which is adapted for glitch-free operation. This is provided by detecting whether each note key is in its released position, its held position or in transition between the released and held positions and preventing any note from sounding until the transition of all actuated note keys is complete.

In accordance with this invention, an improved wind controller is provided which is adapted for glitch-free performance. This is accomplished by providing each of the note keys with a key position sensor for producing a tri-state logic signal having a first state with the key in the released position, having a second state with the key in the held position and having a third state when the key is in transition between the released and held positions. Further, first logic means is coupled with each key position sensor for producing a key position signal, preferably a one-bit signal for each of said keys when said tri-state logic signal is in either the first state or the second state. Further, a key map memory is coupled with the first logic means for storing the key position signals for application to a music synthesizer. Further, second logic means is coupled with each of said key position sensors for producing a key transition signal when said tri-state logic signal is in the third state for disenabling the application of said key position signals from the key map memory to the synthesizer, whereby glitches are avoided in producing a selected note.

Further, in accordance with this invention, an improved wind controller is provided which is adapted for allowing the player to select from two or more alternate fingering or key charts for playing a given piece. Further, the alternate fingerings are implemented so as to properly interpret valid primary and secondary fingerings while ignoring any "mine field" fingerings which should not sound. Preferably, this is accomplished by creating and installing alternate fingering charts to the wind controller using a personal computer coupled with the wind controller for downloading a selected fingering chart.

Further, in accordance with this invention, an improved wind controller is provided which is adapted for playing chords. Preferably, this is accomplished by providing the instrument with a set of chord keys in conjunction with a computer program which allows the player to register, without sounding, a series of notes to make up a chord under the control of one registration key and then use an enable/disable key which alternately activates the last registered chord for playing or deactivates it to put the instrument back in monophonic mode. Another registration key may be provided to register another chord whereby an endless progression of chords can be played in succession with one chord sounding while the next chord is being silently registered to be sounded next.

A complete understanding of this invention may be obtained from the detailed description that follows taken with the accompanying drawings.

Figure 1:
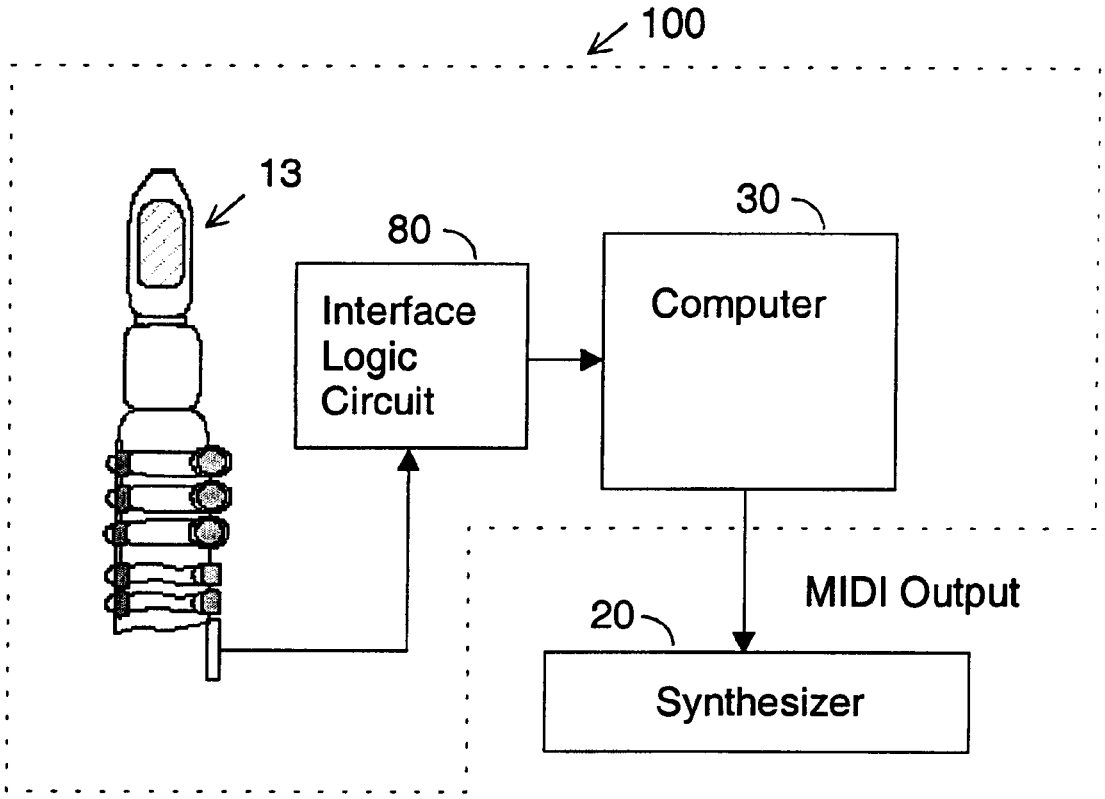
FIG. 1 is a block diagram of a wind controller and the associated electronic circuits for producing a MIDI output.

A complete understanding of this invention may be obtained from the attached drawings and the detailed description that follows.

BEST MODE FOR CARRYING OUT THE INVENTION

Referring now to the drawings, there is shown an illustrative embodiment of the invention in ;a wind controller for simulating the playing characteristics of an acoustic saxophone. It will be appreciated as the description proceeds that the invention is useful in simulating the playing characteristics of other woodwind instruments and may be realized in a wide variety of embodiments.

General Description of the Wind Controller

In the block diagram of FIG. 1, a wind controller is illustrated in connection with a sound or music synthesizer 20. The wind controller 100 comprises, in general, a control instrument 13 which is shown as a fragmentary portion of the instrument which is more fully illustrated in FIGS. 2, 3 and 4. The wind controller 100 also includes an interface logic circuit 80 which receives input data signals from the instrument and develops key map signals and control signals which are applied to inputs of an onboard computer 30. Both the interface logic circuit 80 and the computer 30 are mounted onboard the instrument 13, suitably inside the instrument. The computer 30 develops an output data stream to the synthesizer 20. As discussed above, this data stream is MIDI output data to the synthesizer. This data stream encodes MIDI messages which are input to the synthesizer which controls the notes to be played, at what volume and for what duration by the synthesizer. Additionally, expressive "continuous" control can be included in the message stream to indicate nuances like breath control, vibrato, and the like.

Figure 2:
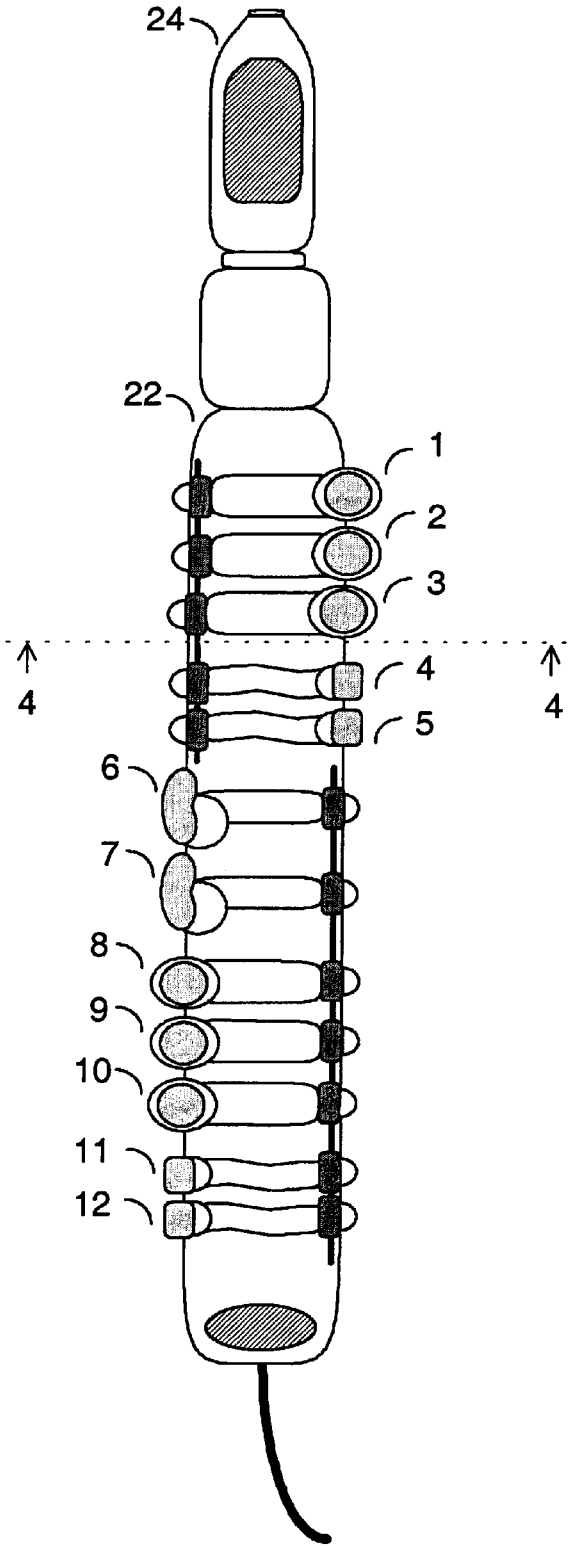
FIG. 2 is a front elevation view of a wind controller.
Figure 3:
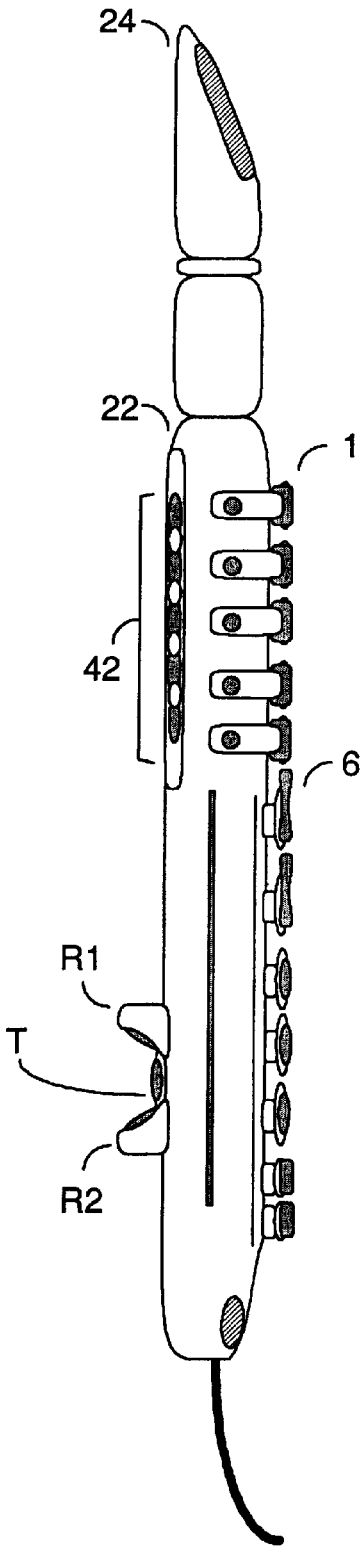
FIG. 3 is a side elevation view of the wind controller of FIG. 2.
Figure 4:
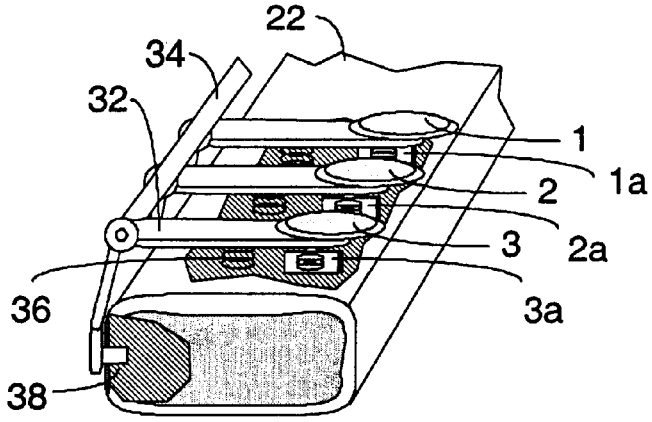
FIG. 4 is a perspective view of the controller of FIG. 2 taken on a section 4—4 of FIG. 2.

As shown in FIGS. 2, 3 and 4, the control instrument 13 comprises an instrument body 22 which supports a plurality of keys which are actuated by the player to produce key data signals which are applied to the logic interface circuit 80. The instrument is provided with a set of left hand note keys comprising keys 1 through 5 and a set of right hand note keys 6 through 12. Additionally, a set of octave keys 42, suitably eight in number, are provided for selection of the octave in which the note keys are played. Further, the instrument is provided with chord keys R1, R2 and T for playing chords and which are located for operation by the player's right thumb.

With a wind controller, the player selects notes using keys controlled by the four fingers of each hand. The player selects an octave with the thumb of the left hand. Volume on a wind controller (or "velocity" and "after-touch" in MIDI parlance) is controlled by the amount of air blown by the player into the mouthpiece of the instrument. Similarly, vibrato (or "pitch bend" in MIDI parlance) is accomplished by the player bending a simulated reed up and down in the mouthpiece with a jaw action.

Glitch-Free Control

As discussed above, glitch-free control of note generation is provided, according to this invention, by ensuring that no note is played while a note key of the instrument is in transition between the released position and the held position. According to this invention, this is accomplished by inhibiting note generation during the time any note key is in transition. This is preferably achieved, as will be described below, by providing each note key with a key position sensor which produces a tristate logic signal. Suitably the logic signal has a first state when the key is in the released position, a second state when the key is in its held position and a third state when the key is in transition between the released and held positions.

Although conventional electrical binary switches A and B will be described, it will be appreciated that other types of switches can be used to provide an equivalent function. For example, a capacitive touch "switch" switch with a mechanical contact which would produce a tristate signal. Also, two capacitive switches could be used to produce a tristate signal. Another example is a pressure sensitive switch with three pressure levels providing a tristate signal.

Note Key Position Sensors

Figure 5:
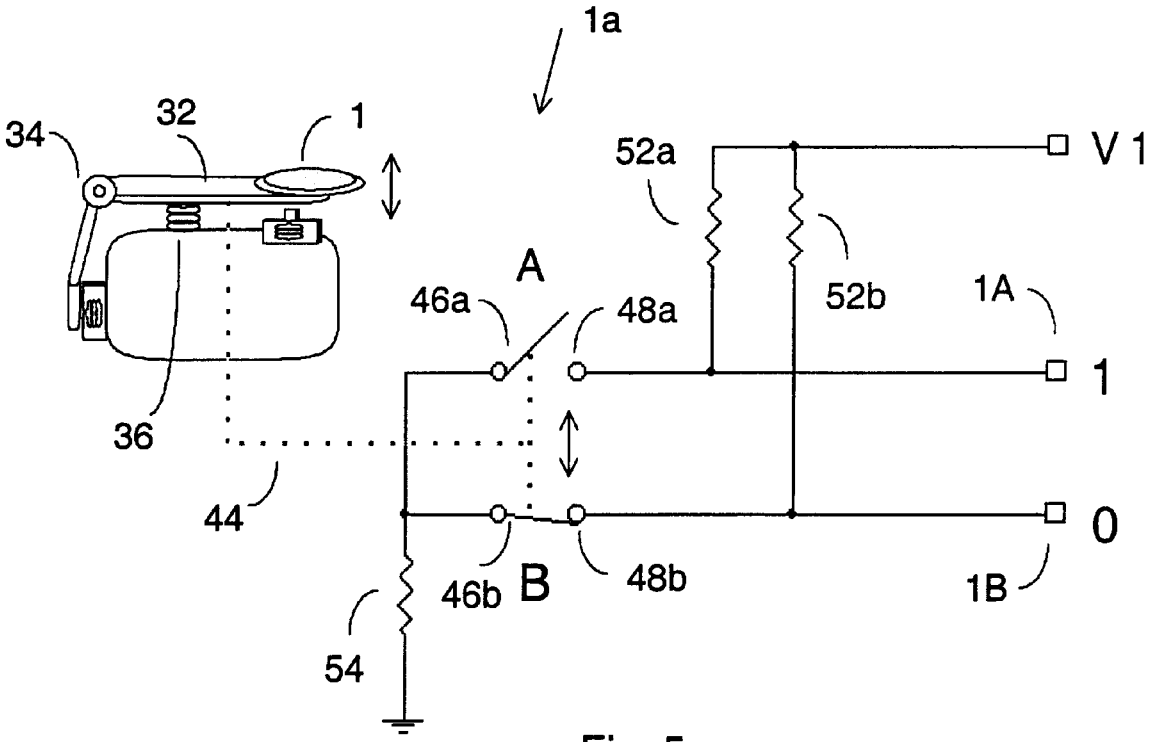
FIG. 5 is a schematic diagram of a key position sensor and its operative connection with its associated key.

As indicated in FIG. 4, a separate note key position sensor 1*a* through 12*a* is used with each one of the note keys 1 through 12, respectively. For explanatory purpose, the note key position sensor 1*a* is shown schematically in FIG. 5 in conjunction with its associated note key 1 and is representative of all other note key sensors. The note key coacts with the key sensor through a coupling, suitably a mechanical linkage 44, which is also shown in schematic fashion. The key position sensor 1*a* is a two-bit logic signal generator which is controlled by the movement of its associated note key. The signal generator, per se, includes two binary switches A and B which are coupled with the key 1 by linkage 44. Binary switch A has a movable contact 46*a* and a fixed contact 48*a*. Similarly, binary switch B has a movable contact 46*b* and a fixed contact 48*b*. The movable contacts 46*a* and 46*b* move in unison with each other by reason of the linkage 44 and when the key 1 is in its released position, switch A is in the open state and switch B is in the closed state. A logic level voltage V1 is supplied to fixed contact 48*a* through a pull-up resistor 52*a* and is supplied to fixed contact 48*b* through a pull-up resistor 52*b*. The movable contacts of both switches A and B are connected to ground through a resistor 54. The fixed contact 48*a* is connected with a signal output terminal 1A and the fixed contact 48*b* is connected with a signal output terminal 1B. Thus, with the note key 1 in its up or released position the output on terminals 1A and 1B, respectively, is a binary logic signal 10. When the note key 1 is in its down or held position, switch A is closed and switch B is opened thus a binary logic signal 01. With the key 1 in transition between the released and held positions both switches A and B are open and thus the output logic signal is 11. The key position signals from all of the note keys are decoded to obtain key map data and are processed to obtain a transition signal, when no key is in transition, as will be described below.

In the illustrative embodiment of the invention there are 12 note keys. The generalized case with n note keys (where n is an integer) is as follows. Each of the individual note keys, composed of two binary switches, has a 2-bit binary output, as shown in Table 1. All of the note keys on the instrument together form a network of switches. With a n-key instrument (not including octave keys) this makes for n 2-bit data lines, or a total of n*2 bits of data.

TABLE 1

| Switch A | Switch B | State | Output |
|---|---|---|---|
| open | open | TR - Key is in transition | 11 |
| open | closed | UP - Key is in up position | 10 |
| closed | open | DN - Key is in down position | 01 |
| closed | closed | (Not possible) | None |

The n*2 inputs from the key position sensors are processed to obtain n bits (D1–Dn) of key map data and one extra transition bit (TR) to signify when the n-bit output is ready to be latched into the microprocessor memory. When no key is in transition between the released position and the held position, the transition bit TR will go low and the data on D1–Dn will be latched into the microprocessor memory. When one or more keys is in the transition state, TR will go to logic high, indicating that the D1–Dn data is to be withheld from the microprocessor memory.

Interface Logic Circuit

As mentioned above, the interface logic circuit 80 is interconnected between the key position sensors 1*a* through 12*a* and the on-board computer 30. The interface logic circuit 80 functions to convert n*2 inputs into n bits (D1–Dn) of key map data and into one transition bit (TR) to signify when the n-bit output is ready to be latched into the microprocessor memory.

Figure 7:
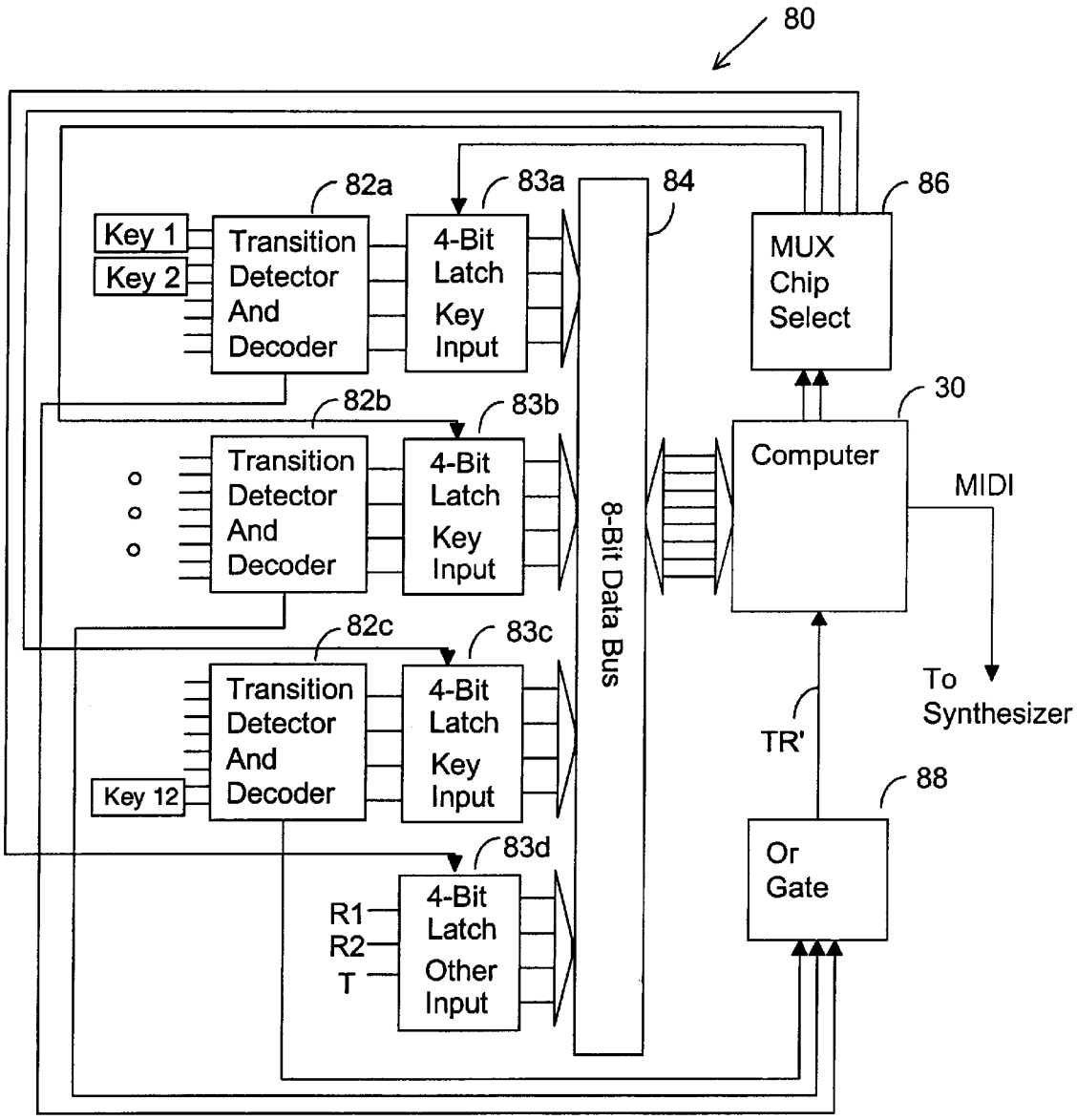
FIG. 7 is a block diagram of an interface logic circuit between the key sensors and the wind controller.
Figure 8:
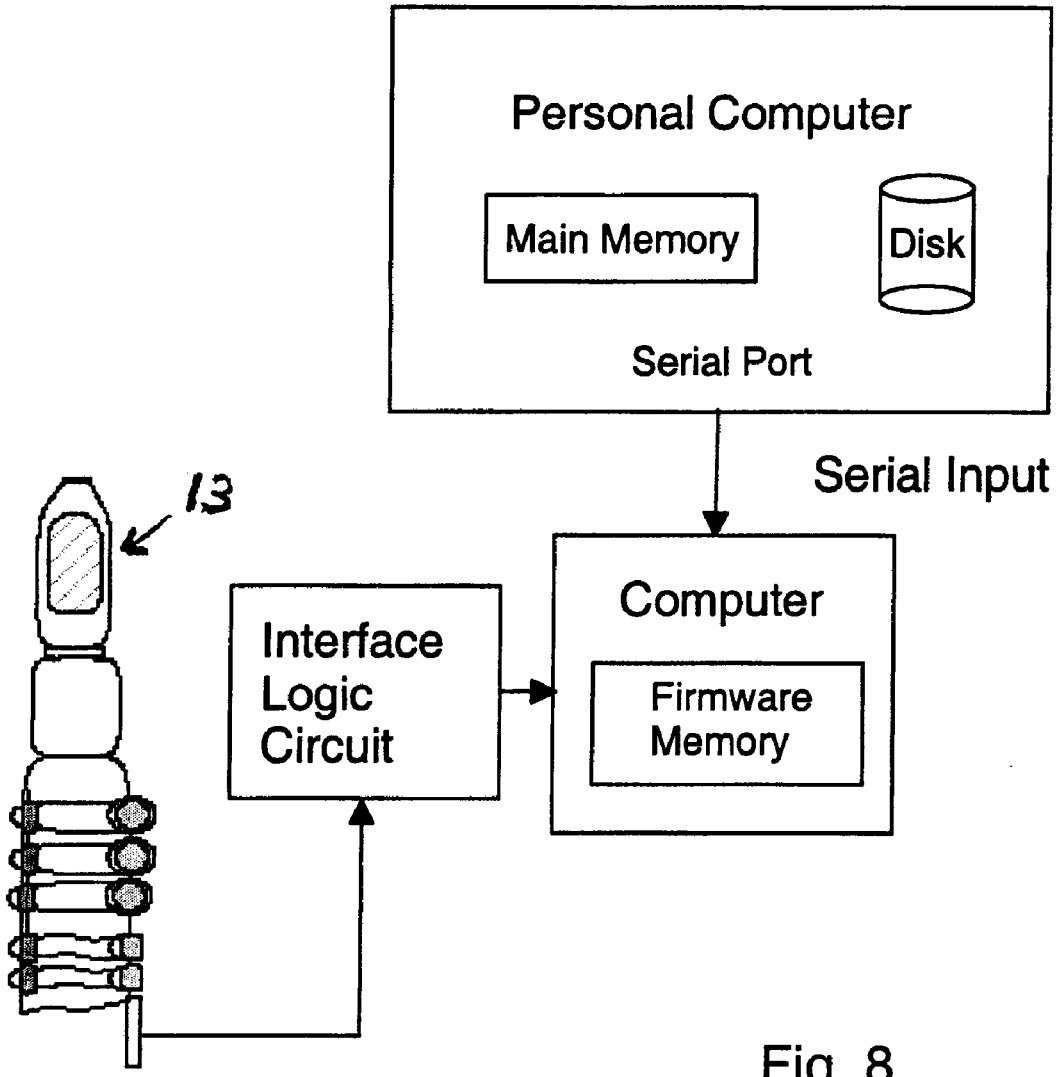
FIG. 8 is a block diagram of a downloading system for fingering charts.

The interface logic circuit 80 will now be described with reference to FIG. 7. As discussed above, the interface logic circuit receives the key position signals from the note key position sensors 1*a* through 12*a* and converts them to one-bit data signals which are applied to input data pins of the computer 30. The computer converts the key position signals along with certain control signals to MIDI output signals which are applied to the synthesizer 20.

The interface logic circuit 80 comprises, in general, a set of three transition detector and decoder circuits 82*a*, 82*b* and 82*c*, each of which receives a set of four 2-bit key position signals from an associated set of four note keys. Each transition detector and decoder circuit converts the 2-bit key position signals to a corresponding set of one bit key position signals. The interface logic circuit 80 also comprises a set of three latch circuits 83*a*, 83*b* and 83*c* which receive and store the one-bit key position signals from the transition detector and decoder circuit 82*a*, 82*b* and 82*c*, respectively. The outputs of the latch circuits 83*a*, 83*b* and 83*c* are coupled with the data bus 84. An additional latch circuit 83*d* is provided which stores input control signals produced by chord keys R1, R2 and T for application to the data bus 84. More latch circuits may be used, as needed, for inputs such as control signals for pitch bend, breath control and octave keys. A multiplexer 86 is controlled by clock signals from the computer 30 and sequentially applies select signals to the latches 82*a*, 82*b*, 82*c* and 82*d* to sequentially apply the data stored in the latches through the bus 84 to the computer 30. Each transition detector and decoder circuits 82*a*, 82*b* and 82*c* processes the 2-bit key position signals applied thereto and produce an output transition signal TR which is applied to an OR gate 88. When all of the key transition signals applied to the OR gate 88 are in the logic zero state, the transition signal TR' applied to the computer 30 triggers the computer to produce a stream of MIDI data including the key map data stored in the computer memory. The transition detector and decoder circuits 82*a*, 82*b* and 82*c* each comprise separate key transition detector circuits 60*a*, 60*b* and 60*c* and separate key decoder circuits 70*a*, 70*b*, 70*c* and 70*d* which will be described below. The computer 30 operates under program control to process the successive sets of note key sensor position signals to produce MIDI signals which are applied to the synthesizer 20.

Key Transition Detector Circuits

Figure 6A:
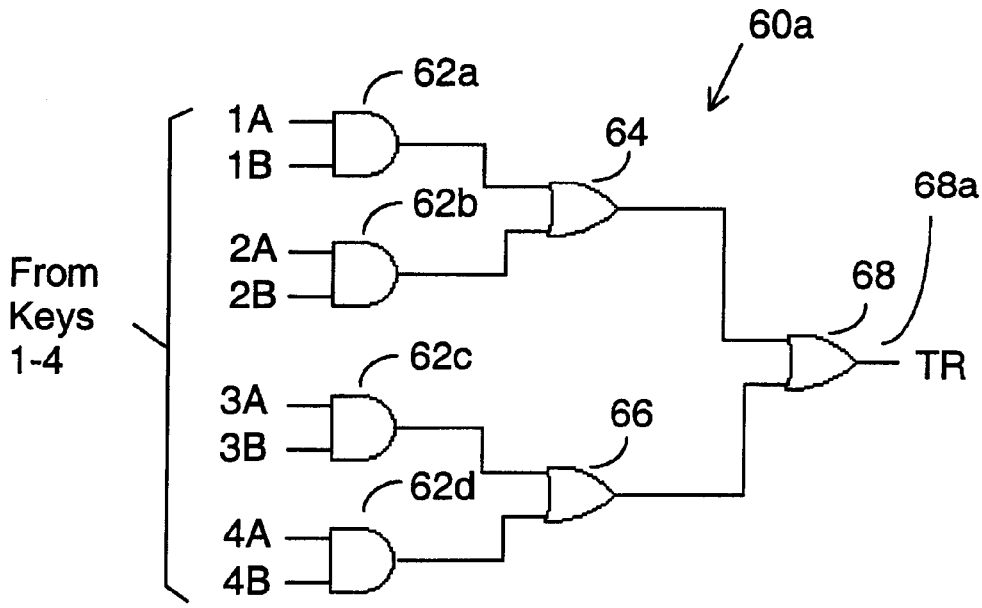
FIG. 6A is a schematic diagram of a key transition detector circuit.

For the purpose of determining whether any note key is in transition, the output signals of all of the key position sensors 1*a* through 12*a* are applied to the inputs of a set of key transition detector circuits 60*a*, 60*b* and 60*c* which are incorporated in transition detector and decoder circuits 82*a*, 82*b* and 82*c*, respectively. One transition detector circuit 60*a* is shown in FIG. 6A and receives the key position sensor signals from note keys 1, 2, 3 and 4. (The transition circuits 60*b* and 60*c* are not shown but are identical to detector circuit 60*a*. It is to be understood that the output signals of key position sensors for note keys 5, 6, 7 and 8 are applied to the inputs of detector circuit 60*b* and similarly, the key position output signals of note keys 9, 10, 11 and 12 are applied to the inputs of the detector circuit 60*c*.

The key transition detector circuit 60*a*, as shown in FIG. 6A, comprises a set of four AND gates 62*a*, 62*b*, 62*c* and 62*d*. Each AND gate has two input pins which are connected with the respective output terminals 1A and 1B of the associated key position sensor. The outputs of the AND gates 62*a* and 62*b* are applied to the respective inputs of an OR gate 64 and the outputs of the AND gates 62*c* and 62*d* are applied to the respective input pins of an OR gate 66. The output pins of the OR gates 64 and 66 are connected to the respective input pins of an OR gate 68 which develops a key-in-transition indicator bit TR on the output pin 68*a*. It will be understood from the logic circuit arrangement of FIG. 6A that the indicator bit TR will be a logic 1, i.e. logic high, if the binary inputs of any one of the AND gates is logic 11 which is indicative of the associated key being in-transition. Also, it will be understood that the transition indicator bit TR will be a logic 0, i.e. logic low, only if each AND gate has a binary input signal of 10 or 01 which indicate that the associated key is in either the released position or the held position, respectively.

If any one of the key transition detector circuits 60*a*, 60*b* or 60*c* has a key-in-transition indicator bit TR in the logic 1 state, the key position sensor signals will not be applied through the interface logic circuit 80 until the key-in-transition indicator bits TR of transition detector circuits 60*a*, 60*b* and 60*c* are all in a logic low state.

Decoder Circuits

Figure 6B:
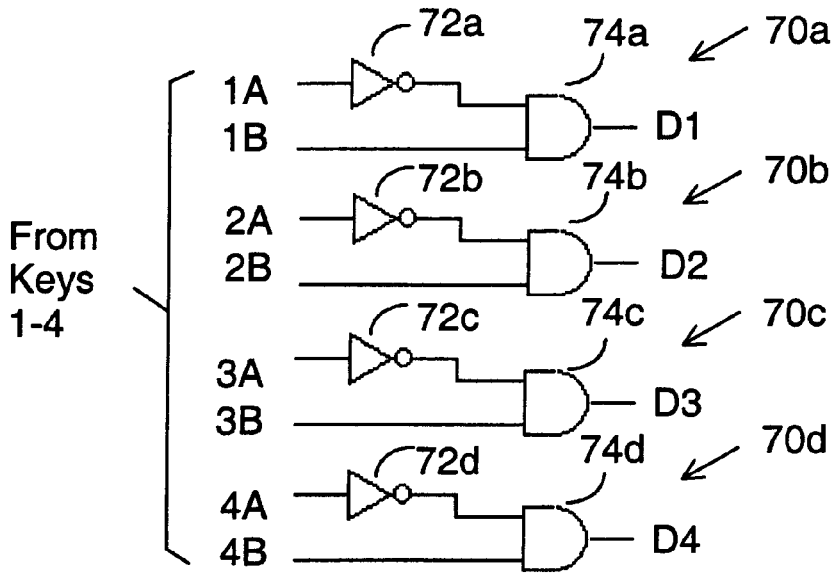
FIG. 6B is a schematic diagram of a set of key signal decoder circuits.

As mentioned above, the transition detector and decoder circuits 82*a*, 82*b* and 82*c* each includes a key position decoder circuit for translating the 2-bit key position signal to a one bit key position signal. Preferably, this signal translation is performed, in a well-known manner, in software in the computer 30; however for the sake of explanation, a simple key position decoder circuit is shown in FIG. 6B. As shown in FIG. 6B there are individual decoder circuits 10*a*, 70*b*, 70*c* and 70*d* corresponding with key position sensors 1*a*, 2*a*, 3*a* and 4*a*, respectively. As indicated in the interface logic circuit 80 of FIG. 7, the 2-bit key position signals (1A,1B) from the key positions 1 through 12 are applied to corresponding input terminals on the transition detector circuits 60*a*, 60*b* and 60*c* and the decoder circuits 70*a* through 70*l* of which only 70*a*, 70*b*, 70*c* and 70*d* are shown. The decoder 70*a* comprises input terminals 1A and 1B which are connected with output terminals 1A and 1B of the key position sensor 1*a*. The logic data signal on input terminal 1A is applied through the logic inverter gate 72*a* to one input of an AND gate 74*a*. The logic signal on input terminal 1B is applied to the other input of the AND gate 74*a*. The output signal D1 of AND gate 74*a* has a logic state 0 when the input signal is 10 on terminals 1A and 1B, respectively, and has a logic state 1 when the input signal is 01. Each of the other key decoder circuits 70*b*, 70*c* and 70*d* are identical to decoder circuit 70*a* and operate in the same manner. Also, it is noted that the transition detection and, decoder circuits 82*b* and 82*c* are of the same circuitry as that described with reference to transition detector and decoder circuit 82*a*.

Alternate Fingering Charts

According to this invention, customizable key layout for a wind controller, is provided by means of downloadable fingering charts along with the electronics and embedded programming to properly interpret valid primary and secondary fingerings, while also recognizing and ignoring any "mine field" fingerings which should not sound. The instrument will accept preconfigured fingering charts (for, say saxophone and flute) as well as user-defined fingering charts. In this system, hardware and software are employed which use combinational logic and a random-access memory to implement a sparse lookup table.

As will be shown below, the invention makes it possible to reconfigure the wind controller to use alternative charts by way of a firmware update. The fingering chart is implemented using a computer memory of the onboard computer.

An instrument with n note selection keys and m octave keys (only one of the octave keys can be actuated at a time) will have $2^n$*m possible key combinations, and only some of these key combinations correspond to an actual note that should be sounded. As an example, an instrument with 10 note selection keys and 8 octave keys will have 1024*8 or 8192 possible key combinations.

Using a random access computer memory (preferably non-volatile RAM) lookup table, these possible combinations can be used to address stored data representing the actual note corresponding to the key combination. As a specific example, the binary key combination "1001 1101 0000 0001 00" might be used as a way of determining an address in memory for the MIDI note number data "0111 1100" and so forth for all 8192 possible key combinations. Many of the key combinations will refer to coded data indicating no corresponding note number, as well.

Note that one could accomplish the same task without the interface logic circuit described above, but by using a much larger computer memory instead. However, this would increase the number of inputs, and correspondingly would increase the amount of required memory exponentially. Instead of $2^n$*m combinations, the array of switches would result in $2^{2*n}$*m. In the example, 8,388,608 storage locations would be required (or 8 MB). This amount of memory, while not prohibitive, would call for much greater development cost.

So, by using combinational logic to conserve memory, the present invention can easily store multiple fingering charts. For example, a 64K memory can store up to 8 different woodwind fingering charts; perhaps these would include charts for saxophone, flute, clarinet, recorder, and some experimental fingering charts as well. But the important point is that this invention allows customizable fingering charts unlike anything in the prior art.

The process of downloading a fingering chart into the instrument can be accomplished using a standard serial computer cable and a personal computer. Using special software to load or prepare a new fingering chart, the user will be able to download that chart into the nonvolatile memory of the wind controller. The new chart could then be used immediately. This kind of memory download can be accomplished using means already well known in the art of electronics, but is still unique its application to the wind controller.

An example key chart according to the invention is illustrated in Tables 2, 3 and 4 below. In Table 2 below, the key map for a selected octave is shown for all notes in the octave according to the conventional key layout for an acoustic saxophone.

TABLE 2

Key Map Table

| Note in Octave | Key Map |
|---|---|
| A | 110 00 00 000 00 |
| A♯ | 110 00 01 000 00 |
| B | 100 00 00 000 00 |
| C | 010 00 00 000 00 |
| C♯ | 000 00 00 000 00 |
| D | 111 00 00 111 00 |
| D♯ | 111 00 00 111 10 |
| E | 111 00 00 110 00 |
| F | 111 00 00 100 00 |
| F♯ | 111 00 00 010 00 |
| G | 111 00 00 000 00 |
| G♯ | 111 10 00 000 00 |

In Table 3 below, three different alternate fingerings are shown for the note C. Numerous alternates are possible for the other notes in the octave.

TABLE 3

| Note in Octave | Key Map |
|---|---|
| C | 100 10 00 000 00 |
| C | 111 00 00 111 01 |
| C | 000 00 00 100 00 |

In Table 4 below, the legend indicates the relation between the bit position in the key map and the reference characters of the wind controller keys shown in FIG. 2.

TABLE 4

Legend for Kay Map Data:
Values: 1 indicates key held; 0 released

| | |
|---|---|
| Bit 0 (leftmost) | Key 1 (refer to FIG. 2) |
| Bit 1 | Key 2 |
| Bit 2 | Key 3 |

TABLE 4-continued

| Legend for Kay Map Data: Values: 1 indicates key held; 0 released | |
|---|---|
| Bit 3 | Key 4 |
| Bit 4 | Key 5 |
| Bit 5 | Key 6 |
| Bit 6 | Key 7 |
| Bit 7 | Key 8 |
| Bit 8 | Key 9 |
| Bit 9 | Key 10 |
| Bit 10 | Key 11 |
| Bit 11 | Key 12 |

The process of creating and installing, or downloading, alternate fingering charts, or key charts to the wind controller comprises of three steps as described below. These steps involve a conventional personal computer (PC) comprising program, main memory, file storage, and serial communications. Also involved is the wind controller itself, comprising program, firmware memory, and serial communications. First, the user creates a new key chart or customize an existing chart using software on the personal computer called the "fingering chart layout program." In this step the user specifies one or more fingerings for each of the 12 notes in an octave. This may be done by working with a symbolic on-screen representation of the wind controller keys, and/or by using a MIDI input to the computer and entering the fingerings using the wind controller itself. When fingerings for all twelve notes have been entered, the key chart will be saved in a data file on disk, to be called a "fingering chart file". A brief algorithm for this program would look as follows:

--Load existing fingering chart from disk to main memory

--Alternatively, create new chart in main memory

==While there are notes of an octave yet undefined:

--Select an undefined note from an octave

--Let user mark which keys are held to produce this note

--Store key map in memory, associated with the note in question

==While alternate fingering for same note is desired by user

|--Mark which keys are held to represent the alternate fingering

|--Store key map in memory, associated with the note in question

--End While

--End While

--Save the fingering chart to disk, using a descriptive name

Second, the user connects the wind controller to the personal computer by way of a serial cable connection (similar to that used to connect a personal computer to a modem).

Third, the user runs a utility program on the personal computer to download a chart to the wind controller. This software is referred to as the "fingering chart download program". This program accepts the name of a fingering chart to transmit, and transfers data to the wind controller firmware memory. The download program is run by giving the following command at a computer:

$ download-chart "Saxophone—with trill alternates"

The algorithm for this program would be as follows:

For the personal computer:

--Load the fingering chart named in the command into memory

--Open a serial connection to the wind controller

--Send the fingering chart data to the wind controller

For the wind controller computer:

--Establish a serial connection to the personal computer

--Read the fingering chart data from serial connection into firmware

Chording And Comping

In accordance with this invention, a wind controller is adapted to produce chords. This is preferably implemented in computer software in the onboard computer 30 together with manual input by the player via a set of chord keys on the wind controller. The implementation of this feature calls for three binary switches. The set of chord keys include key R1 (for registration 1), key R2 (for registration 2), and key T (for toggle). FIG. 3 shows the arrangement of these keys under the thumb of the right hand. Key R1 is held for the silent "registration" of a series of notes to make up a chord; key T is an enable/disable key which alternately activates the last registered chord for playing or deactivates it putting the instrument back in a monophonic mode; and key R2 is another registration key to be used alternately with the first in a rocking motion, thus permitting an endless progression of chords to be played in succession, one sounding while the next is being silently registered to sound next. These keys are arranged under the thumb of the right hand, an area normally used as a simple thumb rest. The details of implementing this key positioning and the computer control circuitry and programming required to implement the chording feature will be described below.

When either key R1 or R2 is depressed, a signal is sent to the controlling microprocessor indicating that all subsequent keyed note entries should be recorded as a chord to be played when the T key is next depressed. Notes entered while either key R1 or R2 is depressed will not sound while they are being registered. Each of the keys R1 and R2 have a separate storage location in the computer memory associated with it for recording a sufficiently large number of notes (say, a chord of up to 64 note polyphony, or 64 bytes of storage).

A computer algorithm (given in detail below) causes the most recently entered chord to sound when the T button is depressed, and this chord will continue to sound until the T key is released and pressed again. The release-press cycle of the key T causes one chord to be entered silently while another chord is playing. Thus, the key T produces a toggle action in producing two chords. For example, the listing below is a sequence of key presses which would allow two chords to be played, one after the other:

1) Press and hold R1.
2) Enter several notes for chord one.
3) Release R1.
4) The instrument continues to work monophonically.
5) Press and release T.
6) The chord will sound (when sufficient breath input is applied).
7) Now press and hold R2, the first chord is still sounding.
8) Enter several notes for chord two.
9) Release R2.
10) The first chord is still sounding.
11) Press and release T.
12) The second chord will sound (again, with sufficient breath).

This sequence can be repeated indefinitely to produce a smooth chord progression. To return the instrument back to monophonic mode, the following key sequence would executed:

1) Press and release R1 or R2.
2) Press and release T.
3) Because no chord notes were registered, chording ends.

In addition, once two chords are entered, it is possible to toggle between them without having to re-enter the chords. Similarly, either the R1 or the R2 chord can be replaced with a new chord at any time while leaving the other chord registered. The following is an example of switching back and forth between two chords.

1) Follow the procedure for entering two chords.
2) Press and release T to toggle.
3) The alternate chord will sound.
4) Press and release T to toggle again.
5) The previously playing chord will sound.

The computer algorithm for interpreting these key sequences is shown next, using a of "pseudocode" which is easily understood and converted into a specific programming language by anyone skilled in computer programming. This algorithm is used to introduce chord playing capability to a wind controller.

```
Algorithm
  --Main Module to Interpret Chording Keys R1, R1, and T
    -Declare variables R1, R2, T, State, Last-Played
    -Declare variables CountR1, CountR2, Note
    -Declare arrays R1-Chord, R2-Chord
    -Set State to Mono
    -Set Count R1 to 1
    -Set Count R2 to 1
    -Set Last-Played to Mono
    -Initialize arrays to be empty
  =Loop continuously
    |-Read inputs from switches R1, R2, T into variables
    |-If R1 is pressed
    ||-Set State to Reg1
    ||-Perform Disable-MIDI-Output module [not shown]
    ||-Perform R1-Held module
    |-End If
    |
    |-If R2 is pressed
    ||-Set State to Reg2
    ||-Perform Disable-MIDI-Output module [not shown]
    ||-Perform R2-Held module
    -End If
    |
    |-If T is pressed (and not R1 or R2 is pressed)
    ||Perform Toggle module
    -End If
    |
    -If none of R1, R2, or T are pressed
    ||Set CountR1 to 1
    ||Set CountR2 to 1
    ||Perform Enable-MIDI-Output module [not shown]
    |-End If
    -End Loop
  --End Module
  --Toggle Module
    -If State is Mono
    |-If R1-Chord array is not empty
    ||And Last-Played is not Poly1
    ||-Set State to Poly1
    ||-Set Last-Played to Poly1
    |-Else if R2-Chord array is not empty
    ||And Last-Played is not Poly2
    ||-Set State to Poly2
    ||-Set Last-Played to Poly2
    |-Else
    ||-Set State to Mono
    ||-Set Last-Played to Mono
    |-End If
    -End If
    -If State is Poly1
    |-If R2-Chord array is not empty
    ||-Set State to Poly2
    |-Else
    ||-Set State to Mono
    |-End If
    -End If
    -If State is Poly2
    |-R1-Chord array is not empty
    ||-Set State to Poly1
    |-Else
    ||-Set State to Mono
    |-End If
    -End If
  --End Module
  --R1-Held Module
    -Perform Read-Note module
    -Set Note to result of Read-Note
    -If Note is not null
    |-Set R2-Chord [CountR1] to Note
    |-Set CountR1 to CountR1+1
    -End If
  --End Module
  --R2-Held Module
    -Perform Read-Note module
    -Set Note to result of Read-Note
    -If Note is not null
    |-Set R2-Chord[CountR2] to Note
    |-Set CountR2 to CountR2+1
    -End If
  --End Module
  --Disable-MIDI-Output Module
    [This module would instruct other parts of the control program not to pass the notes being entered along to the output section of the program. In other words, the notes entered will be quiet. They will be stored in a chord array to be played later.]
  --Enable-MIDI-Output Module
    [Similar to the Disable-MIDI-Output module, this module will allow the notes entered on the instrument to sound by putting the MIDI output section of the program back in service.]
  --End Module
  --Read-Note Module
    [This module instructs the control program to latch a note input from the instrument. Bear in mind that for a note to be latched there must be a non-zero volume (or velocity) signal coming from the mouthpiece. The details of the mouthpiece input and transducer are not described here.]
  --End Module
```

CONCLUSION

Although the description of this invention has been given with reference to particular embodiments it is not to be construed in a limiting sense. Many variations and modifications will now occur to those skilled in the art.

What is claimed is:

1. In a wind controller of the type adapted for use with a music synthesizer to produce a sequence of musical notes, said controller comprising a control instrument having a body member with a plurality of keys mounted thereon, each of said keys being manually movable between a released position and a held position, at least some of said notes requiring a combination of two or more of said keys to be in said held position at the same time, said wind controller also comprising a plurality of key position sensors, each sensor being associated with a different one of said keys for producing a logic signal which represents the position of its associated key, the improvement wherein:

each said key position sensor comprises switching means for producing a tristate logic signal having a first state when its associated key is in said released position, having a second state when its associated key is in said held position, and having a third state when its associated key is in transition between said released and held positions, a key map memory coupled with said key position sensors for storing said tristate logic signals for application co said music synthesizer, and first logic means coupled with each of said key position sensors for producing a disenable signal when the tristate logic signal of any key is in said third state for disenabling the application of said tristate logic signals in said key map memory to said synthesizer, and for enabling said application when the tristate logic signal of no key is in said third state, whereby glitches are avoided in said sequence of musical notes.

2. The invention as defined in claim 1 wherein:

second logic means is coupled with each of said key position sensors for producing a one-bit key position signal for each of said keys when said tristate, logic signal is in either the first state or the second state, and said key map memory is coupled with said second logic means and said first logic means.

3. The invention as defined in claim 1 wherein:

said wind controller includes an onboard memory and said key map memory comprises a latch circuit and said onboard memory.

4. The invention as defined in claim 1 wherein:

said switching means is a pair of binary switches.

5. The invention as defined in claim 1 wherein:

said first logic means is a transition detector comprising plural logic gates.

6. The invention as defined in claim 2 wherein:

said second logic means is a decoder comprising plural logic gates.

7. A method of producing a glitch free data stream of note signals from a wind controller for controlling a music synthesizer to produce a sequence of musical notes, said controller comprising a control instrument having a body member with an onboard computer and a plurality of keys mounted thereon, each of said keys being movable between a released position and a held position, at least some of said notes requiring a combination of two or more of said keys to be in said held position at the same time, said method comprising the steps of:

monitoring the movement of each of the keys which are moved between said released position and said held position to produce a desired note signal, for each said key, producing a tristate logic signal having a first state when said key is in its released position, having a second state when said key is in its held position and having a third state when said key is in transition between said released and said held positions, said tristate logic signal having a two bit format for representing the position of said key, decoding said tristate logic signals to produce a one bit format in said data stream of said note signals representing the held and released positions of each of said keys and processing said tristate logic signals to detect any key in said third state and converting said data stream of note signals in said one bit format to MIDI note signals for controlling said synthesizer for playing said sequence of musical notes, only when none of said tristate logic signals is in said third state, whereby said synthesizer does not receive any MIDI note signals while any one of said keys is in transition between said released and said held positions.

8. A method, as defined in claim 7 for producing a glitch-free data stream of chord signals from said wind controller for controlling said music synthesizer to produce a sequence of chords, said body member and being provided with a set of chord keys, said chord keys including a first registration key, a second registration key and a toggle key, said method comprising the additional steps of:

pressing and holding the first registration key while registering, in succession the note signals of plural notes which represent selected notes for subsequently playing a first chord, releasing said first registration key to end the registration of note signals for the first chord whereby the wind controller continues to work monophonically, press and release said toggle key thereby substantially simultaneously applying the registered key map signals of the first chord to the synthesizer to sound said first chord, while the first chord is still sounding, press and hold the second registration key while registering, in succession, the note signals of plural notes which represent selected notes for subsequently playing a second chord, releasing said second registration key while said first chord is still sounding, and press and release said toggle key thereby substantially simultaneously applying the registered note signals of the second chord to the synthesizer to sound said second chord.

9. A method as defined n claim 7 including the following steps, which are to be executed before the steps of claim 7:

creating a new fingering chart for use in the onboard computer of said wind controller using a personal computer and a fingering chart program, saving said new fingering chart to a personal computer file with a predetermined format, loading said fingering chart from said personal computer file into the personal computer memory, and downloading said new fingering chart in said predetermined format from said personal computer to the memory of said onboard computer, said predetermined format comprising fingering chart data using one bit to represent the held and released position of each of said keys.

10. A method of producing a data stream of note signals from a wind controller for controlling a music synthesizer to produce a sequence of musical notes, said controller comprising a control instrument having a body member with a plurality of keys mounted thereon, each of said keys being movable between a released position and a held position, at least some of said notes requiring a combination of two or more selected keys to be in said held position at the same time, said method comprising the steps of:

monitoring the movement of each of said plurality of keys between said released position and said held position and, for each of said keys, producing a logic signal having a first state when said key is in its released position having a second state when said key is in its held position and having a third state when said key is in transition between said released and said held positions, storing said logic signals for all of said keys until none of said logic signals is in said third scare, and then, using the stored logic signals for producing a data scream of note signals for playing said sequence of musical notes, whereby said synthesizer does not receive said note signals while any one of said keys is in transition between said released and said held positions.

11. A method of manipulating fingering chart data within a personal computer and downloading said data to a wind controller to provide the wind controller with playing characteristics of various woodwinds and have new user-defined playing characteristics, said personal computer having a computer memory and a fingering chart program, said wind controller having an onboard computer and memory, said method comprising the steps of:

creating new fingering chart data in computer memory with said fingering chart program saving said data to a computer file with a predetermined format, loading said new fingering chart data from said computer file into said computer memory, and downloading said new fingering chart data in said predetermined format from said personal computer to said onboard memory of said wind controller computer.

12. The invention as defined in claim 11 wherein said fingering chart data in said predetermined format comprises multiple records, each record having a note number comprising a byte of data and corresponding to one of the one hundred-twenty-eight notes in the complete MIDI range, one or more key map codes for each of said notes each key map code representing the fingering for said note.

13. The invention as defined in claim 12 wherein said onboard memory includes a look-up table which stores note codes each representing an individual MIDI note, each of said key map codes being an address for selecting a corresponding note from the look-up table for transmission to said MIDI synthesizer.

14. A method as defined in claim 13 wherein said predetermined format includes only key map codes in which the permutation of bits is the same as the permutation of bits in one of the key map codes actually assigned to one of said notes and excludes at least some of the other key map codes, whereby unassigned key map codes are omitted from said format and cannot produce an unwanted note.

15. A method of producing a data stream of note signals from a wind controller of the type adapted for use with a music synthesizer to produce a sequence of musical notes, said controller comprising a control instrument having a body member and a plurality of note keys mounted thereon and containing a computer and onboard memory including a key map memory having a plurality of key map codes stored therein, there being at least one unique key map code corresponding to each note in an octave, and a look-up table adapted for storing code representing notes within the MIDI range, each of said keys being selectively movable between a released position and a held position for producing a selected note, at least some of said notes requiring a combination of two or more of said keys to be in said held position at the same time, said method comprising the steps of:

monitoring the movement of each of said keys, and for each of said keys, producing a tristate logic signal having a first state when its associated key is in said released position, having a second state when its associated key is in said held position, and having a third state when its associated key is in transition between said released and held positions, storing the set of said tristate logic signals for each selected note in a logic signal register, converting said tristate logic signals, which comprise n*2 bits, into key map data signals, which comprise n bits total, (where n is the number of note keys) and producing an enable signal when none of said tristate logic signals in said logic signal register is in said third state, upon occurrence of said enable signal, comparing each of said key map data signals with said key map codes stored in said key map memory and, when there is a match of a key map data signal with a key map code, using the key map code as an address for accessing a corresponding code in said look-up table for sending a MIDI note signal to said synthesizer, whereby glitches are avoided in said sequence of musical notes.

* * * * *